United States Patent [19]

Kagerhuber et al.

[11] 4,116,262

[45] Sep. 26, 1978

[54] ARCUATE SUPPORTING AND GUIDING CONSTRUCTION FOR CONTINUOUSLY CAST STRANDS

[75] Inventors: Franz Kagerhuber, Traun; Alois Scheinecker; Werner Scheurecker, both of Linz, all of Austria

[73] Assignee: Vereinigte Österreichische Elsen- und Stahlwerke - Alpine Montan Aktiengesellschaft, Linz, Austria

[21] Appl. No.: 738,535

[22] Filed: Nov. 3, 1976

[30] Foreign Application Priority Data

Nov. 12, 1975 [AT] Austria ..... 8602/75

[51] Int. Cl.[2] ..... B22D 11/12

[52] U.S. Cl. ..... 164/448

[58] Field of Search ..... 164/282, 82, 442, 448; 193/35 R; 226/289

[56] References Cited

U.S. PATENT DOCUMENTS

| | | | |
|---|---|---|---|
| 3,627,026 | 12/1971 | Bohne et al. | 164/282 |
| 3,710,847 | 1/1973 | Schoffmann | 164/282 |
| 3,757,848 | 9/1973 | Scholz et al. | 164/282 |
| 3,779,303 | 12/1973 | Pietryka | 164/282 |
| 3,867,827 | 2/1975 | Backhaus et al. | 164/282 X |
| 3,924,673 | 12/1975 | Vertesi | 164/282 X |

*Primary Examiner*—Francis S. Husar
*Assistant Examiner*—Gus T. Hampilos
*Attorney, Agent, or Firm*—Brumbaugh, Graves, Donohue & Raymond

[57] ABSTRACT

An arcuate supporting and guiding construction for continuously cast strands, in particular slabs, has rollers forming oppositely arranged roller paths supporting the strand, arcuate longitudinal carriers extending over the entire guiding arc and accommodating the rollers, transverse carriers arranged in opposing pairs spaced along and connected by the arcuate longitudinal carriers to back them up, a base, drawing anchors connecting the pairs of transverse carriers, and a fixed bearing and expansion bearings provided on the supporting and guiding arc to connect it with the base.

12 Claims, 4 Drawing Figures

ARCUATE SUPPORTING AND GUIDING CONSTRUCTION FOR CONTINUOUSLY CAST STRANDS

BACKGROUND OF THE INVENTION

The invention relates to a supporting and guiding arc for cast strands, in particular for cast slabs, having roller paths supporting the strand at opposite sides, the rollers of the roller paths being journaled on arcuate longitudinal carriers designed in one piece and extending uninterruptedly over the entire length of the guiding arc. Opposing transverse carriers are spaced along the arcuate longitudinal carriers in pairs in order to back them up.

Such a supporting and guiding arc designed in one piece has the advantage, as compared to a guiding arc assembled of a plurality of segments arranged one behind the other and whose segments are individually mounted on the base, that transitions occurring from one segment to the next segments have to be precisely aligned relative to one another, are avoided. By arranging the supporting rollers in uninterrupted arcuate longitudinal carriers designed in one piece, the rollers lie on pre-determined curve paths without discontinuities. Hitherto these roller-carrying arcuate longitudinal carriers have been installed in an arcuate, self-supporting framework. In order to prevent stepped transitions from the supporting and guiding arc to the bending and straigntening zones or to precisely align these transitions, the framework has been mounted with its ends on the base.

Its great weight has proved disadvantageous in this connection. In part this weight is due to the fact that in order to prevent the sagging of a guiding arc mounted only at its ends, the carrying framework of the guiding arc has to be dimensioned accordingly strong. In steel making plants with crane equipment for low charge weights only, it is necessary to take apart the guiding arc right there where it is for an installation and removal thereof.

SUMMARY OF THE INVENTION

The invention aims at preventing the above; mentioned disadvantages and difficulties and has as its object to provide a supporting and guiding arc of the above; defined kind, whose weight is substantially reduced as compared to the weight of known guiding arcs, wherein, however, the advantages of uninterrupted, roller-carrying arcuate longitudinal carriers designed in one piece are maintained. Furthermore, the supporting and guiding arc according to the invention is to be easily aligned to the adjacent strand guide parts, in particular to the adjacent bending zone and straightening zone. Also, thermal expansions are not to cause discontinuities at these transitions to the bending zone and straightening zone, which would damage the strand.

These objects of the invention are achieved in that the transverse carriers directly connected by the arcuate longitudinal carriers are connected with each other by drawing anchors, and the supporting and guiding arc is mounted on the base in one place of its longitudinal extension, in particular at a transverse carrier, by means of a fixed bearing, and in other places of its longitudinal extension, by means of expansion bearings. The weight of the guiding arc is accommodated by a number of bearings distributed over the longitudinal extension of the arc so that it is possible to eliminate the arcuate framework. According to the invention, the carrying elements between the bearings are the arcuate longitudinal carriers. Thus the weight of the guiding arc is reduced by about 20%.

Suitably, only the two transverse carriers arranged next to each one of the ends of the guiding arc are always mounted on the base. Thus, the middle part of the guiding arc, depending on the bending of the arcuate longitudinal carriers, sags freely, while the end parts of the guiding arc are precisely aligned by their bearings to the strand guide paths following on both sides.

Advantageously, an articulation bearing is provided as a fixed bearing.

Suitably, the fixed bearing is arranged at the lower, run-out end of the supporting and guiding arc.

According to a preferred embodiment of the invention, the fixed bearing comprises one supporting block at each of both ends of a transverse carrier which is rotatably arranged and fixed on the base with exchangeable shims interposed therebetween. The shims having various thicknesses allow for a precise adjustment of the position of the end of the guiding arc on the fixed bearing side.

For accommodating the longitudinal forces acting on the roller path opposite the fixed bearing, it is advantageous that the transverse carrier having the fixed bearing be connected at both sides of the roller paths with the two drawing anchors of a pair of transverse carriers arranged n front of it in the casting direction by means of one diagonal rod each, the diagonal rods being directed to the ends of the drawing anchors opposite the guiding arc side provided with the fixed bearing. Thus a bending load acting on the drawing anchors is prevented.

According to an advantageous embodiment, the expansion bearings are designed as pendulum bracket bearings, the brackets being hinged to the ends of the arc-outer transverse carriers, on the one hand, and to the base extending upwardly lateral of the supporting and guiding arc, on the other hand.

In order for the guiding arc to move approximately in the direction of its arcuate path when it expands and shrinks, the brackets, whose lengths preferably approximately correspond to the distance between the transverse carriers arranged oppositely in pairs, are arranged to point in the direction to the respective center of curvature of the guiding arc.

For a better adaptation of the guiding arc to a predetermined curve path the brackets are composed of two threaded spindles which can be screwed into a sleeve in turnbuckle manner.

According to a further embodiment of the invention, the expansion bearings can also be designed as sliding elements mounted on the ends of the transverse carriers, which sliding elements are guided between two consoles anchored on the base parallel to each other, wherein the inclinations of the consoles are parallel to the tangents laid to the roller paths at the places of the respective expansion bearings. This has the effect that when the guiding arc expands or shrinks, it moves exactly in the direction of its arcuate path.

It can prove to be advantageous to provide pendulum bracket bearings as well as slide bearings as expansion bearings.

BRIEF DESCRIPTION OF THE DRAWINGS

The invention shall now be described by way of example and with reference to the accompanying drawings, wherein.

DESCRIPTION OF EXEMPLARY EMBODIMENTS

Figure 1:
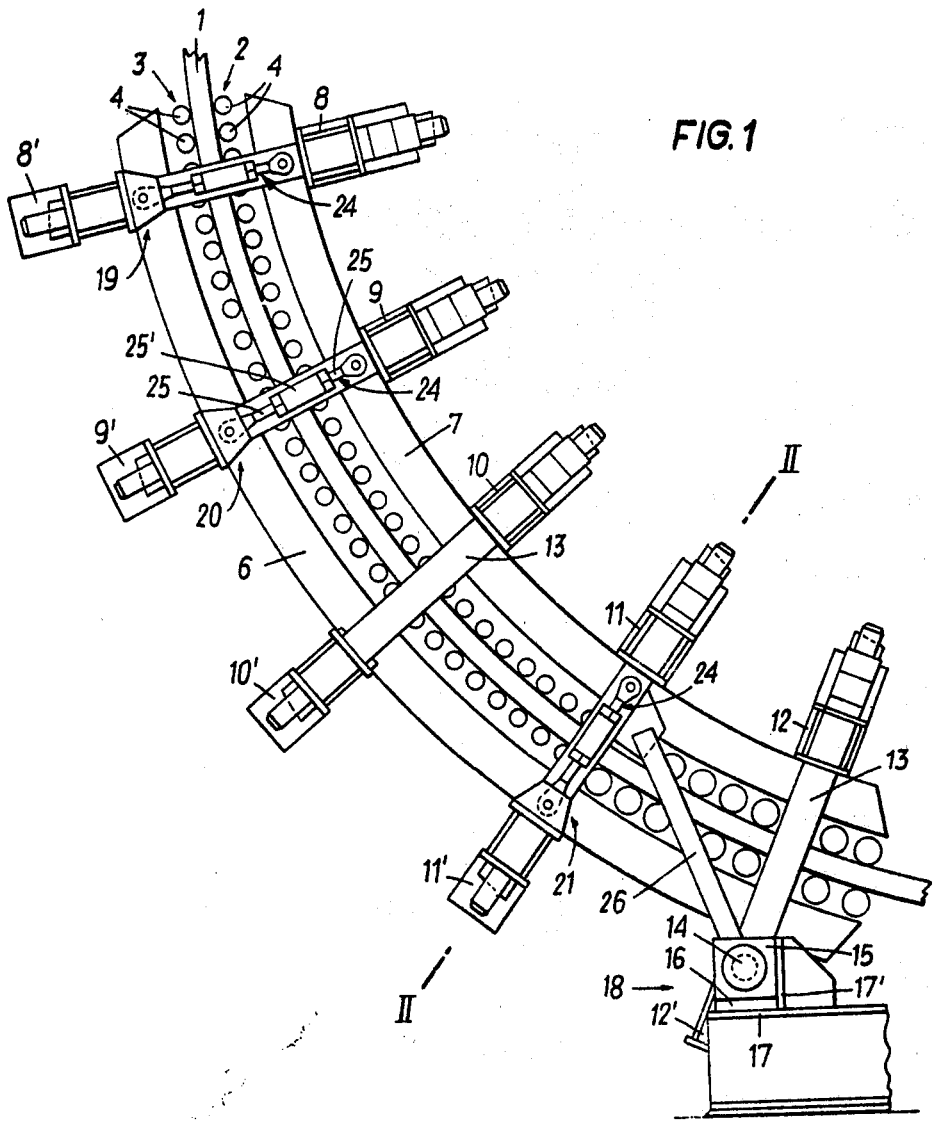
FIG. 1 is a schematic side view of the guiding arc without the base.
Figure 2:
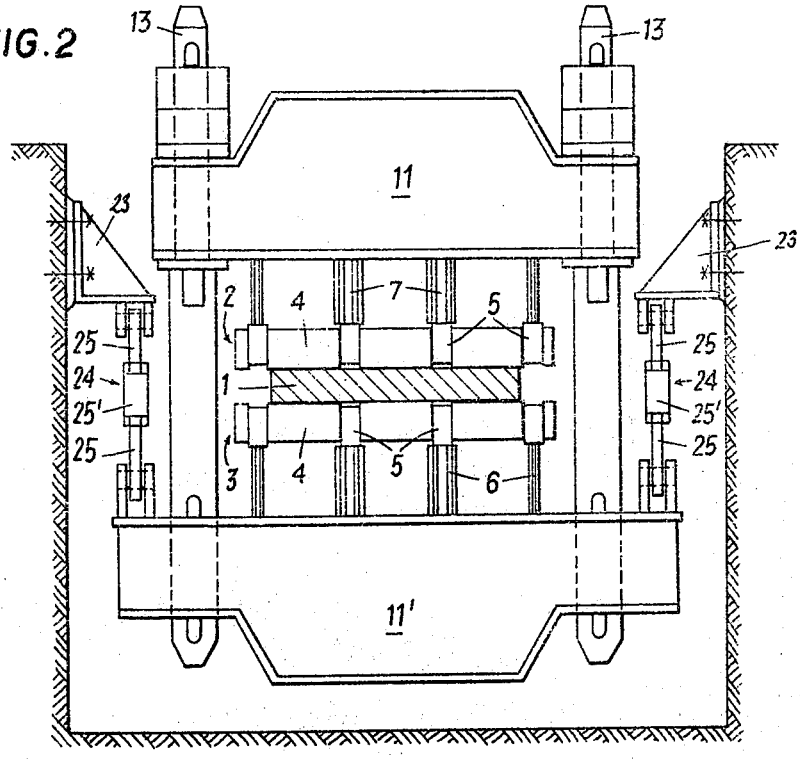
FIG. 2 is an illustration of a section along line II—II of FIG. 1 on an enlarged scale.

By 1 a cast strand is denoted, which strand is extracted from a mould (not shown) and bent in a bending zone arranged below the mould and not illustrated in detail. Thereupon the strand is guided between the arc-inner roller path 2 and the arc-outer roller path 3 of the supporting and guiding arc from approximately the vertical to approximately the horizontal. After the guiding arc, in the extraction direction of the strand, there follows the straightening zone, in which the strand is straightened again. The rollers 4 of the two roller paths 2 and 3 are journaled in bearing supports 5 distributed over their longitudinal extension, which bearing supports are mounted in arcuate longitudinal carriers 6 and 7 designed in one piece and extending over the entire length of the guiding arc. Along the arc-outer arcuate longitudinal carriers 6 and the arc-inner arcuate longitudinal carriers 7, transverse carriers 8, 9, 10, 11, 12 and 8', 9', 10', 11', 12' are arranged at distances from each other so as to back up adjacent arcuate longitudinal carriers 7 and 6, respectively. The transverse carriers 8 to 12 of the roller path 2 each oppose the transverse carriers 8' to 12' of the roller path 3. The arcuate longitudinal carriers are directly connected to the transverse carriers, whereby the transverse carriers and the longitudinal carriers of each roller path form a kind of lattice without any additional framework. The oppositely arranged transverse carriers are connected with each other via drawing anchors 13 arranged at their ends, so that the roller paths 2 and 3 are maintained at a certain distance corresponding to the thickness of the strand to be cast.

According to the invention the guiding arc is mounted on the base via a number of arc-outer transverse carriers. It is only the arrangement on the base that gives the guiding arc the arcuate shape desired.

The transverse carrier 12' arranged at the end of the guiding arc carries one bolt 14 each at its ends, square blocks 15 being rotatably mounted on said bolts. These blocks 15 are supported via exchangeable shims 16 against supporting plates 17 and 17' mounted on the base, and thus form the fixed bearing 18. The blocks 15 can be fixed on the supporting plates 17 and 17' by screws not illustrated in detail. The shims are provided to allow for an alignment of the end of the guiding arc towards the straightening zone following thereupon, which results in a faultless transition to the straightening zone.

The transverse carriers 8', 9' and 11' are connected with the base by expansion bearings 19, 20 and 21 designed as pendulum bracket bearings. The pendulum brackets 24 are hinged, on the one hand, to the ends of the transverse carriers, and, on the other hand, via consoles 23, to the base which extends upwardly lateral of the guiding arc. The brackets 24, whose length approximately corresponds to the distance of between the transverse carriers arranged oppositely in pairs, point to the respective center of curvature of the roller paths and are adjustable in their lengths for adjustment of the desired arcuate shape. They are composed of two threaded spindles 25 which can be screwed into a sleeve 25' in turnbuckle manner. By rotating the sleeve 25' the desired length can be adjusted.

If the guiding arc expands, e.g. due to thermal influences, it is forced to follow with its transverse carriers 8', 9' and 11' the circular paths which the brackets 24 describe during the pivoting around their end mounted on the base-side, i.e. the arcuate shape of the guiding path remains nearly unchanged. Thus the faultless transition to the following strand guide stands is safeguarded during the casting operation.

In order to prevent the extraction forces acting on the arc-inner roller path 2 from being transmitted — via the drawing anchors, on which they would act as a bending load — to the arc-outer roller path, the two drawing anchors connecting the transverse carriers 11 and 11' with each other are supported against the transverse carrier 12' provided with the fixed bearing, via a diagonal rod 26.

Figure 4:
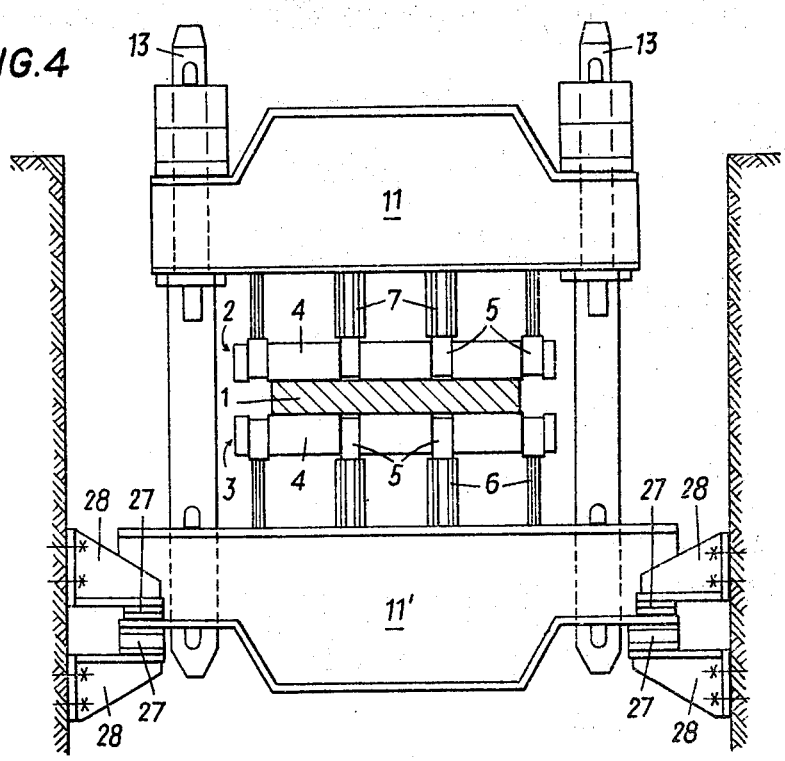
FIGS. 3 and 4 show a different embodiment of the supporting and guiding arc according to the invention in illustrations like FIGS. 1 and 2.
Figure 3:
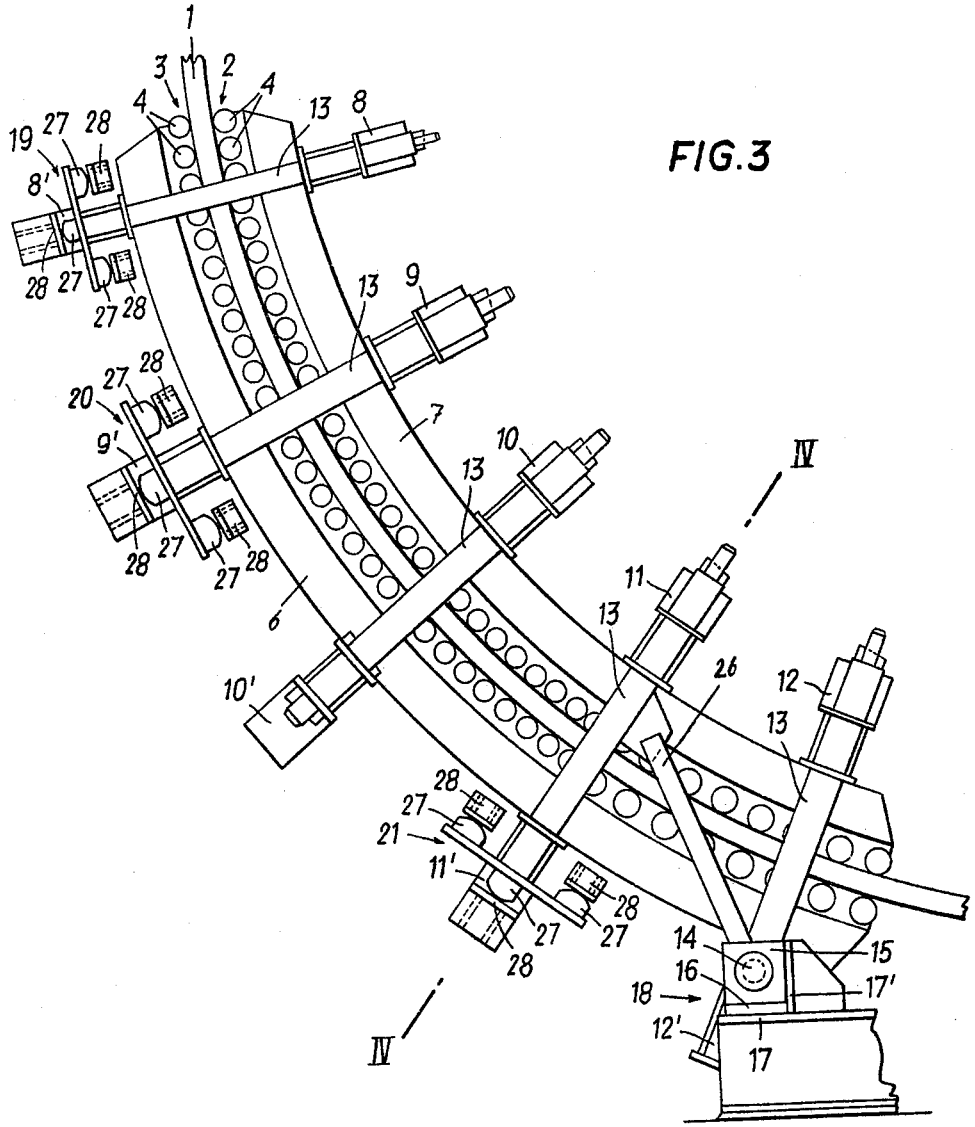

FIGS. 3 and 4 illustrate another embodiment of the guiding arc according to the invention. Here the expansion bearings 19, 20 and 21 are designed as slide bearings, the slide elements 27 being provided at the ends of the transverse carriers 8', 9' and 11' with some of the elements 27 directed to the inside and some to the outside of the arc. The elements 27 are guided between two consoles 28 anchored on the base, which also here is designed to extend upwardly lateral of the guiding arc. The inclination of the consoles 28 along their longitudinal axes corresponds to the inclination of the tangents to the roller paths 2 and 3 at the respective expansion bearing. Thereby the guiding arc is forced to move with its sliding elements 27 along the consoles 28 in such a manner that the faultless alignment of the guiding arc with the strand guide parts following thereupon is safeguarded during the casting operation.

Advantageously, the arcuate longitudinal carriers of the arc-inner roller path 2 are adjustable or braceable, respectively, relative to the oppositely arranged roller path under elastic deformation for adjustment of various roller distances.

We claim:

1. An arcuate supporting and guiding construction for a continuous casting plant having a base and producing continuously cast strands, in particular slabs, comprising:

oppositely arranged rollers forming roller paths to support the strand on opposite sides thereof;

uninterrupted arcuate longitudinal carriers extending over the entire length of the supporting and guiding construction and accommodating said rollers;

transverse carriers spaced along and being directly connected by the arcuate longitudinal carriers so as to back them up, said transverse carriers being arranged in opposing pairs;

drawing anchors connecting each opposing pair of transverse carriers;

a fixed bearing provided on one of said transverse carriers for directly mounting said one transverse carrier on the base, thereby mounting said arcuate supporting and guiding construction on the base of the plant; and expansion bearings provided on other transverse carriers along the arcuate supporting and guiding construction for mounting said other transverse carriers on the base, thereby additionally mounting said arcuate supporting and guiding construction on said base.

2. An arcuate supporting and guiding construction as set forth in claim 1, wherein only two transverse carriers next to each end of the arcuate supporting and guiding construction are mounted on the base.

3. An arcuate supporting and guiding construction as set forth in claim 1, wherein the fixed bearing is an articulation bearing.

4. An arcuate supporting and guiding construction as set forth in claim 1, wherein the fixed bearing is arranged at the lower, run-out end of the arcuate supporting and guiding construction.

5. An arcuate supporting and guiding construction as set forth in claim 1, wherein the fixed bearing comprises one supporting block rotatably journaled at each of the two ends of a transverse carrier, said supporting blocks being secured to the base via intermediate exchangeable shims.

6. An arcuate supporting and guiding construction as set forth in claim 1, further comprising a diagonal rod provided on each side of the roller paths to connect the fixed-bearing-containing transverse carrier with the drawing anchors of the pair of transverse carriers arranged in front of it in the casting direction, the diagonal rods being directed to those ends of the drawing anchors which are opposite to the fixed-bearing-containing side of the arcuate supporting and guiding construction.

7. An arcuate supporting and guiding construction as set forth in claim 1, wherein the base extends upwardly lateral of the arcuate supporting and guiding construction and the expansion bearings are designed as pendulum bracket bearings whose brackets are hinged to the ends of the arc-outer transverse carriers, on the one hand, and to the laterally upwardly extending base, on the other hand.

8. An arcuate supporting and guiding construction as set forth in claim 7, wherein the brackets are arranged to point in the direction of the respective center of curvature of the arcuate supporting and guiding construction.

9. An arcuate supporting and guiding construction as set forth in claim 8, wherein the brackets have lengths corresponding approximately to the distance between the transverse carriers arranged in opposing pairs.

10. An arcuate supporting and guiding construction as set forth in claim 7, wherein the brackets comprise two threaded spindles and a sleeve, the threaded spindles being screwable into said sleeve in turnbuckle manner.

11. An arcuate supporting and guiding construction as set forth in claim 1, wherein the expansion bearings are designed as sliding elements mounted on the ends of the respective transverse carriers, two consoles being anchored on the base and extending parallel to each other to guide the sliding elements between them, the consoles having inclinations extending parallel to tangents laid to the roller paths at the sites of the respective expansion bearings.

12. An arcuate supporting and guiding construction as set forth in claim 1, wherein the expansion bearings comprise pendulum bracket bearings and slide bearings.

* * * * *